US007992574B2

(12) United States Patent
Jahnke et al.

(10) Patent No.: US 7,992,574 B2
(45) Date of Patent: Aug. 9, 2011

(54) METHOD AND APPARATUS FOR CUTTING A CONTINUOUSLY GUIDED ROD INTO ROD-SHAPED ARTICLES OF VARIABLE LENGTH

(75) Inventors: Matthias Jahnke, Hamburg (DE); Konrad Popp, Augsburg (DE); Detlef Ahlborn, Gross Almerode (DE)

(73) Assignee: Hauni Maschinenbau AG, Hamburg (DE)

( * ) Notice: Subject to any disclaimer, the term of this patent is extended or adjusted under 35 U.S.C. 154(b) by 634 days.

(21) Appl. No.: 11/229,802

(22) Filed: Sep. 20, 2005

(65) Prior Publication Data

US 2006/0065278 A1 Mar. 30, 2006

(30) Foreign Application Priority Data

Sep. 24, 2004 (DE) ..... 10 2004 047 265

(51) Int. Cl.
*A24C 5/12* (2006.01)
*A24C 5/28* (2006.01)

(52) U.S. Cl. ..... 131/65; 131/58; 131/60

(58) Field of Classification Search ..... 83/373, 83/344–346; 131/84.1–84.4
See application file for complete search history.

(56) References Cited

U.S. PATENT DOCUMENTS

| | | | | |
|---|---|---|---|---|
| 3,398,617 | A * | 8/1968 | Lanore | 83/331 |
| 3,636,806 | A | 1/1972 | Vyncke | |
| 3,772,952 | A | 11/1973 | Gianese | |
| 4,030,511 | A * | 6/1977 | Wahle | 131/280 |
| 4,377,098 | A | 3/1983 | Bardenhagen et al. | |
| 4,537,205 | A | 8/1985 | Verjux | |
| 4,693,261 | A * | 9/1987 | Okumoto | 131/84.1 |
| 5,050,471 | A | 9/1991 | Niemann | |
| 5,255,777 | A * | 10/1993 | Pawelko | 198/471.1 |
| 2002/0124696 | A1 * | 9/2002 | Wohltmann | 83/13 |

FOREIGN PATENT DOCUMENTS

| | | | |
|---|---|---|---|
| DE | 1 207 254 | B | 12/1965 |
| DE | 1 956 440 | A1 | 6/1970 |
| DE | 22 33 0964 | A | 1/1974 |
| DE | 25 05 516 | B2 | 5/1978 |
| DE | 34 18 935 | A1 | 11/1984 |
| DE | 37 06 550 | A1 | 9/1987 |

(Continued)

OTHER PUBLICATIONS

German Translation of Japanese Office Action mailed on Jul. 27, 2010 in related Japanese Patent Application No. 2005-274838, plus English Translation of German Translation.

(Continued)

*Primary Examiner* — Matthew J Daniels
*Assistant Examiner* — Jodi Cohen
(74) *Attorney, Agent, or Firm* — Venable LLP; Robert Kinberg; Steven J. Schwarz

(57) ABSTRACT

The invention concerns an apparatus for cutting at least one continuously conveyed rod into rod-shaped articles of variable length, in particular cigarettes, filters or the like, including a cutting device, a counter-support and displacing devices for the cutting device and the counter-support for varying the cut length of the articles, which is characterized in that the displacing devices for the cutting device and the counter-support are coupled together to make a functional connection. Furthermore, the invention concerns a corresponding method which is characterized in that, to alter the length of the articles to be cut off the rod, only one component is displaced, namely optionally the cutting device or the counter-support, and the other component is automatically displaced with it as a function of the displaced component.

3 Claims, 12 Drawing Sheets

FOREIGN PATENT DOCUMENTS

| | | | |
|---|---|---|---|
| DE | 39 19 999 | A1 | 1/1991 |
| DE | 31 40 769 | C2 | 11/1991 |
| DE | 196 32 740 | A1 | 2/1997 |
| DE | 199 33 107 | A1 | 2/2001 |
| EP | 0 500 300 | A2 | 8/1992 |
| EP | 0 745 462 | A2 | 12/1996 |
| GB | 1 336 984 | A | 11/1973 |
| JP | 56 151490 | A | 11/1981 |

OTHER PUBLICATIONS

European Search Report issued Oct. 28, 2010 in related European Application No. 10075385.4-2302.

* cited by examiner

METHOD AND APPARATUS FOR CUTTING A CONTINUOUSLY GUIDED ROD INTO ROD-SHAPED ARTICLES OF VARIABLE LENGTH

CROSS-REFERENCE TO RELATED APPLICATION

This application claims the priority of German Patent Application No. 10 2004 047 265.3 filed Sep. 24, 2004, the subject matter of which is incorporated herein by reference. The disclosure of all U.S. and foreign patents and patent applications mentioned below are also incorporated herein by reference.

BACKGROUND OF THE INVENTION

The invention concerns an apparatus for cutting at least one continuously conveyed rod into rod-shaped articles of variable length, in particular cigarettes, filters or the like, including a cutting device, a counter-support and displacing devices for the cutting device and the counter-support for varying the cut length of the articles. Further, the invention concerns a continuous rod-making machine for the manufacture of rod-shaped articles, in particular cigarettes, filters or the like, essentially including a storage container for the material to be processed, means for forming at least one continuously conveyed rod, a rod conveyor and an apparatus for cutting the continuously conveyed rod. Furthermore, the invention concerns a method for cutting at least one continuously conveyed rod into rod-shaped articles of variable length, in particular cigarettes, filters or the like, including the steps of: delivering the rod into the region of an apparatus for cutting in particular according to any of claims 1 to 21, with a cutting device, a counter-support and displacing devices for the cutting device and the counter-support, cutting at least one article of a first length from the rod, displacing the cutting device and counter-support to an altered article length, and cutting at least one article of a second length which differs from the first length.

Methods and apparatuses of this kind are used in particular in the tobacco-processing industry. Usually, the generic apparatuses form part of a continuous rod-making machine for the manufacture of cigarettes, filters or the like. But the apparatuses can also be used as a single machine. During manufacture, single sections, the so-called sticks, are separated from the endless rod of tobacco, filter material or the like, by means of the apparatus for cutting. These cuts must be made with precision to produce a high and constant quality. The apparatus for cutting is preferably arranged above or below a rod or several rods. At the point of intersection of cutting device and rod, the counter-support must be opposite the cutting device in order to prevent lateral yielding of the rod and at the same time to ensure guiding of the rod. Only by this means is a precise and reproducible cutting quality achieved.

Depending on the job to be performed with the apparatus or with the continuous rod-making machine, possibly an alteration of cut length of the articles is necessary. This means e.g. that in a first job cigarettes having a first length are to be separated from the rod, and then, in a subsequent job, cigarettes having a second length which differs from the first length. As already mentioned, an essential condition of optimum cutting is that the positions of cutting device and counter-support are firstly adapted to the respective cut length and secondly coordinated with each other. In other words, displacement of the cutting device and counter-support for each article length is required.

With known apparatuses and methods, the alteration of cut length is associated with considerable work expenditure. Thus, first of all various fastenings, e.g. screw joints, of the separate units comprising cutting device and counter-support must be undone in order to successively displace the cutting device and the counter-support individually and coordinate them with each other. This is very time-consuming and can take place only when the machine is at a standstill, which in turn leads to a breakdown of production. Furthermore, displacement and coordination of the necessary displacements can be carried out only by trained personnel, because it is only with many years' experience that optimum adjustment and optimum coordination can be obtained.

SUMMARY OF THE INVENTION

It is therefore the object of the present invention to provide an apparatus which enables simplified displacement for cutting articles of variable length. Further, it is the object of the invention to provide a continuous rod-making machine which is easy to adjust. A further object consists in proposing a method for cutting articles of variable length which is simple and easy to handle.

This object is firstly achieved by an apparatus with the characteristics mentioned hereinbefore by the fact that the displacing devices for the cutting device and the counter-support are coupled together to make a functional connection. As a result, in a surprisingly simple and particularly effective manner an alteration of the length of the articles to be cut is guaranteed. The apparatus of adjustable length according to the invention ensures that the displacement of one component by means of the functional connection leads to automatic simultaneous displacement of the other component. In other words, displacement e.g. of the cutting device inevitably leads to corresponding displacement of the counter-support. Furthermore, the functional connection provides automatic and inevitable adaptation of the displacement of the cutting device on the one hand and of the displacement of the counter-support, on the other hand, this being without any intervention by an operator. Accordingly, inter alia quick and reliable displacement of the whole apparatus is advantageous, the displacement requiring no special technical knowledge or experience. Furthermore, due to the functional connection of the above-mentioned components, release and fixing expenditure is considerably reduced, as the actual displacement has to be made on only one single component.

Preferably, an adjusting drive is associated with both the counter-support and the cutting device, whereby the adjusting drives are connected to each other by a control system for making the functional connection. As a result, easy adjustment of the cutting device and counter-support is assisted particularly effectively.

In an advantageous development of the invention, a device for superimposing a displacing movement in addition to the actual driving movement is associated with the counter-support. On the one, the device enables particularly easy and precise displacement of the counter-support depending on the selected article length. On the other hand, the device also ensures adjustment or displacement of the position of the counter-support during operation of the apparatus, so that down-times of the apparatus for the purposes of displacement can be reduced or even completely avoided.

Particularly preferred is the structure of the device as an addition gear mechanism. The addition gear mechanism is particularly suitable for realizing the displacements/adjustments coordinated with each other.

Furthermore, the object is achieved by a continuous rod-making machine with the characteristics mentioned hereinbefore by the fact that the apparatus for cutting is designed according to any one of claims 1 to 21. The advantages obtained as a result have already been described above, so that, to avoid repetition, reference is made to the statements regarding the apparatus itself.

Moreover, the object is achieved by a method with the steps mentioned hereinbefore by the fact that, to alter the length of the articles to be cut off the rod, only one component is displaced, namely optionally the cutting device or the counter-support, and the other component is automatically displaced in interdependence with the displaced component. As a result, the adjustment expenditure is considerably reduced. Furthermore, coordination of the individual components with each other does not depend on the operator, as automatic displacement of the other component on the basis of the displaced component results in automatic adaptation.

Preferably, displacement can also take place while the machine is running, so that stopping of the machine can be dispensed with and a breakdown of production can be avoided.

BRIEF DESCRIPTION OF THE DRAWINGS

Further advantageous and preferred characteristics, embodiments or method steps are apparent from the subsidiary claims and the description. Particularly preferred embodiments and the method are described in more detail with the aid of the attached drawings. The drawings show:

DETAILED DESCRIPTION OF THE INVENTION

The apparatus and the method serve to cut articles off an endless rod or several parallel-guided rods of tobacco, filter material or the like with a length adjustment of the apparatus for cutting articles of variable length.

Figure 1:
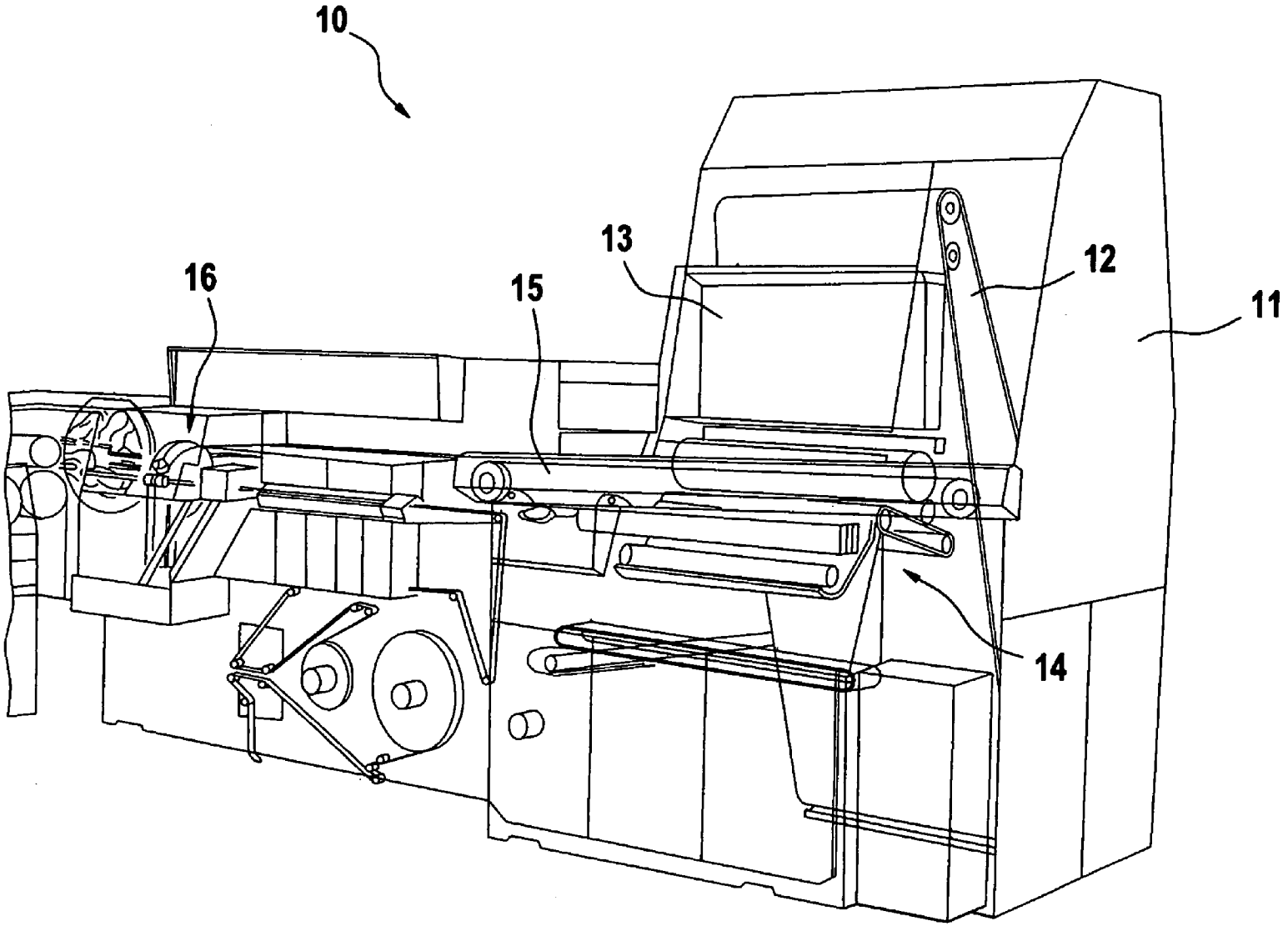
FIG. 1 a perspective view of a continuous rod-making machine with an apparatus for cutting a continuously conveyed rod into rod-shaped articles, FIG. 2 a schematic view of a first embodiment of the apparatus for cutting with a cutting device, a counter-support, a common drive for the above components, and a control system for linking the components, FIG. 3 a schematic view of a further embodiment of the apparatus for cutting with a cutting device, a counter-support, a common drive for the above components, and a control system for linking the components, FIG. 4 a schematic view of a further embodiment of the apparatus for cutting with a cutting device, a counter-support, separate drives for the above components, and a control system for linking the components, FIG. 5 a functional view of the cutting device which is engaged with the rod, FIG. 6 a side view of a first embodiment of the counter-support with an eccentric unit designed as a double eccentric in section, FIG. 7 a side view of a further embodiment of the counter-support with an eccentric unit designed as a rack rail system in section, FIGS. 8*a* to *d* detailed views of the rack rail system according to FIG. 7, FIGS. 9*a* and *b* detailed views of a further embodiment of the rack rail system, FIG. 10 a front view of a further embodiment of the counter-support as a tube wheel, and FIG. 11 a side view of the embodiment according to FIG. 10 in section.

For greater clarity, with the aid of FIG. 1 first an apparatus known as a continuous rod-making machine 10 is shown, which serves to manufacture rod-shaped articles, e.g. cigarettes, filters or the like. The continuous rod-making machine 10, shown in the figure by way of example as a continuous cigarette rod-making machine, essentially includes, in addition to a storage container 11 for the material to be worked and processed, a conveyor 12 for transporting the material out of the storage container 11 to an accumulating shaft 13, means 14 for forming a rod or several parallel rods, a rod conveyor 15 and an apparatus 16 for cutting the continuously conveyed rod or several continuously conveyed rods. The continuous rod-making machine 10 can be designed as a single, double or multiple rod-making machine. Essentially, continuous rod-making machines 10 are constructed in a corresponding manner for other products, e.g. filters. In particular, each continuous rods-making machine 10 includes an apparatus 16 for cutting the continuously conveyed rod.

Figure 2:
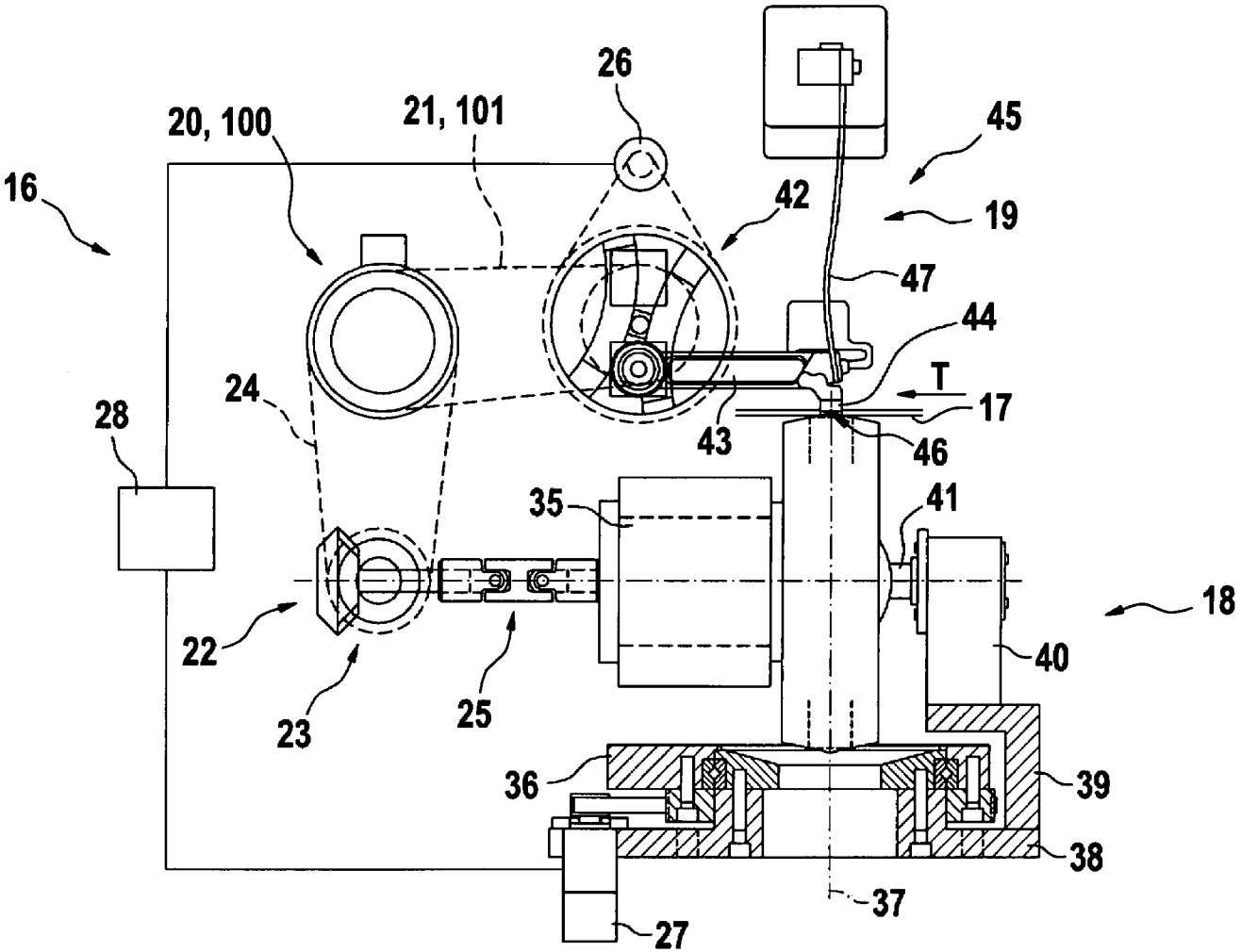

The principle of a first embodiment of this apparatus 16 for cutting for example a single continuously conveyed rod 17 into rod-shaped or strand-like articles, which can also be operated as a single, separate unit, is described in more detail first with reference to FIG. 2. The apparatus 16 essentially includes a cutting device 18 and a counter-support 19. A drive means 20 is directly associated with the counter-support 19, whereby the drive means 20 is functionally connected to the counter-support 19 by means of a toothed belt 21 or similar means. The drive means 20, however, also serves to drive the cutting apparatus 18. For this purpose, a mechanical coupling 22 is provided. The mechanical coupling 22 is designed as a bevel gear set 23. However, other common couplings 22 can be used as well. The bevel gear set 23 is functionally connected to the drive means 20 by a toothed belt 24 or similar means. The coupling 22 is connected by a joint element 25, preferably a universal joint, to the cutting device 18 in order to drive it. An adjusting drive 26 or 27 is associated with both the counter-support 19 and the cutting device 18. The adjusting drives 26, 27 in turn are connected to each other by a control system 28 for making the functional connection.

Figure 3:
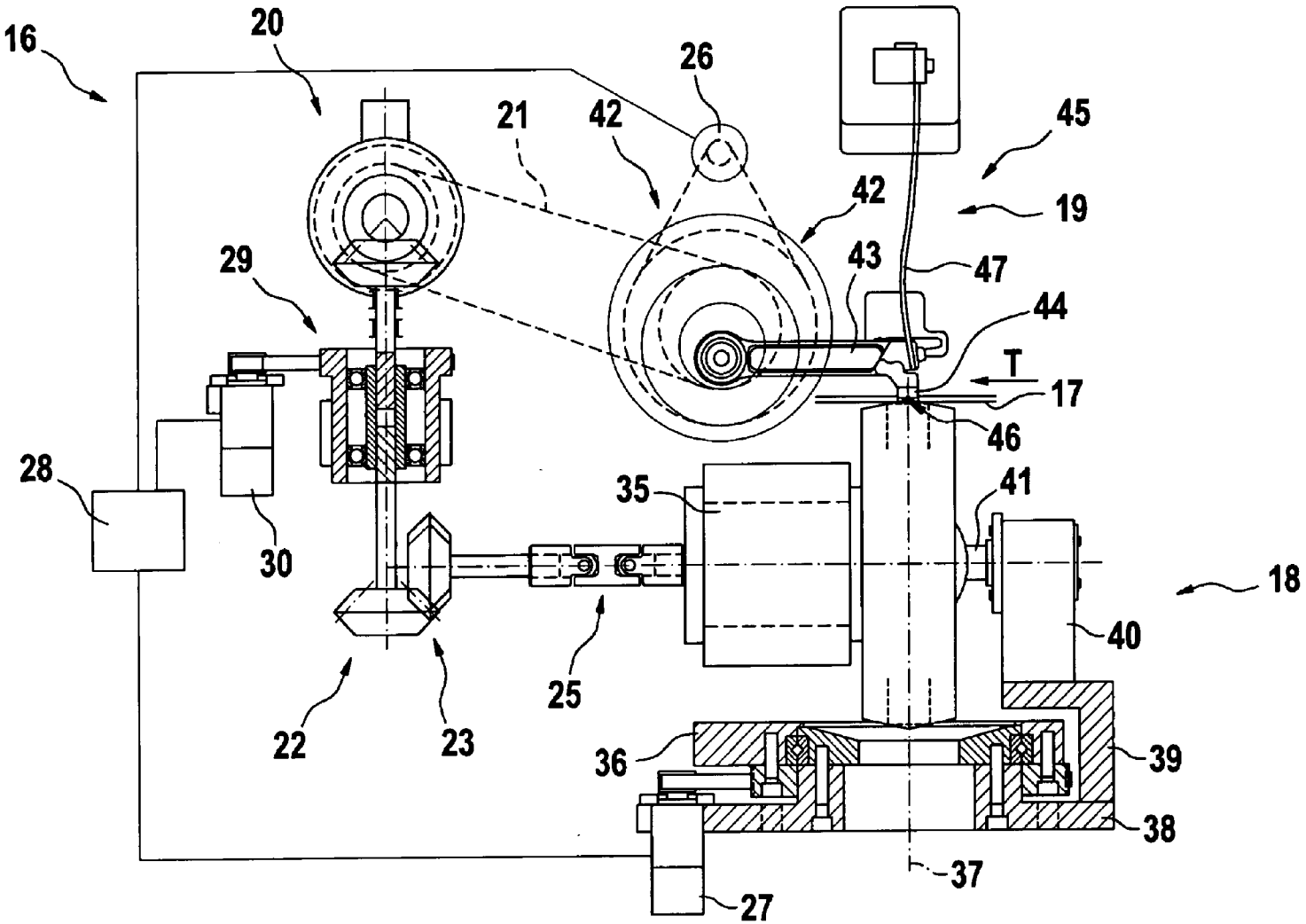

A further embodiment of the invention is shown in FIG. 3. The apparatus 16 is basically designed similarly to the apparatus 16 described above, so that the corresponding reference numerals are used for the same parts. To make the functional connection between the drive means 20 and the coupling 22 a displacement gear mechanism 29 is provided which is associated with the mechanical coupling 22. The displacement gear mechanism 29 serves to equalise the phase shift of the drive means 20 which is triggered by displacement of the counter-support 19. The displacement gear mechanism 29 is manually displaceable. Preferably, however, an adjusting drive 30 is associated with the displacement gear mechanism 29. The adjusting drive 30 for its part is connected to the control system 28, which is also connected to the adjusting drives 26, 27 of the cutting device 18 and counter-support 19.

In the embodiment of FIG. 4, which again has the essential components of the embodiments described above, a drive means 20 is associated with the counter-support 19 and a separate drive means 31 is associated with the cutting device 18. The drive means 20, 31 are connected to each other by a control system to make the functional connection. Preferably, the control system is the control system 28 which already connects the adjusting drives 26, 27 to each other. In other words, both the cutting device 18 and the counter-support 19 are assigned their own main drive 31 or 20, and their own adjusting drive 27 or 26.

The essential components of the cutting device 18 are a cutting wheel 32 rotatable with the drive means 31 and at least one blade 33. The cutting wheel 32 is arranged at an angle in relation to the rod 17. Details of this are described more precisely below with the aid of FIG. 5. Preferably, several blades 33 are distributed over the circumference of the cutting wheel 32 with the cutting wheel diameter $D_s$ and arranged equidistant from each other. Each of the blades 33 is designed to be movable on the cutting wheel 32, namely, preferably rotatable or pivotable about an axis running radially relative to the cutting wheel 32. To vary the angle of inclination β between cutting wheel 32 or blade 33 and rod 17, the cutting wheel 32 is displaceable, namely in particular pivotable.

Figure 5:
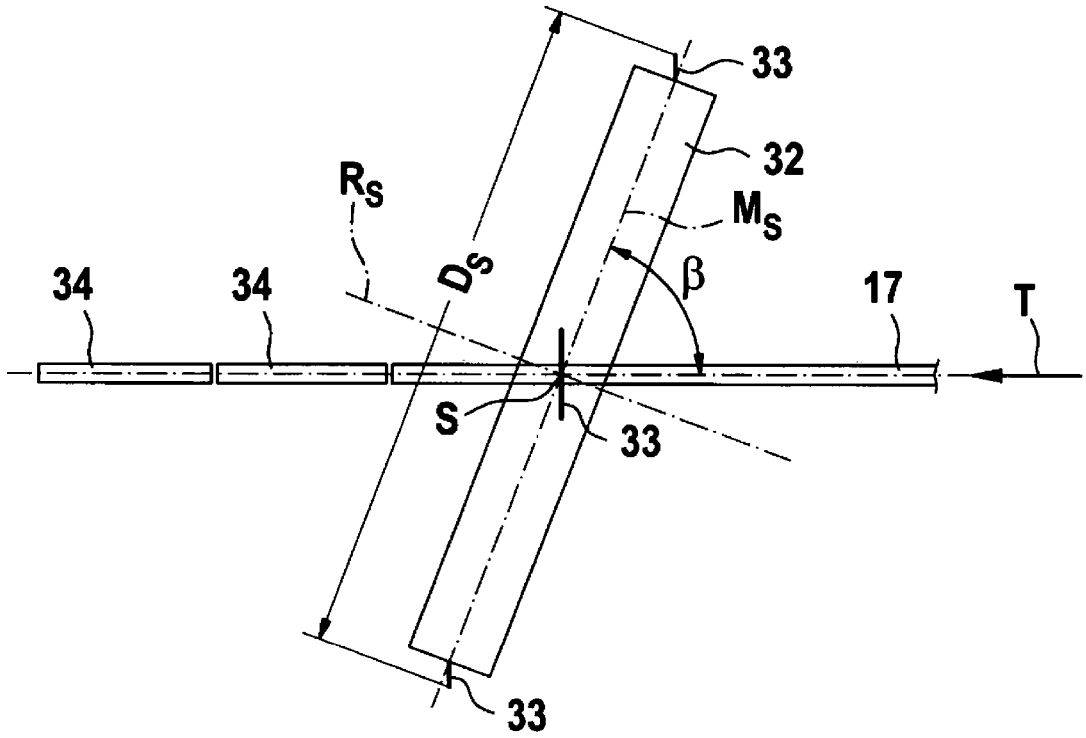

It can be taken from the functional diagram of FIG. 5 that the or each rod 17 is conveyed continuously in the direction of transport T. The axis of rotation $R_s$ of the cutting wheel 32 runs at an angle to the rod 17. As a result, the centre axis $M_s$ of the cutting wheel 32 also runs obliquely or inclined at an angle, the so-called helix angle or angle of inclination β, to the rod 17. The angle β is preferably between 60° and <90°. The blades 33 are arranged on the cutting wheel 32 so as to run perpendicularly to the rod 17 at the point of intersection S with the rod 17. Due to the inclination at the above angle β and the rotation of the cutting wheel 32, there is a horizontal, preferably axial speed component of the cutting wheel 32 or of the respective blade 33 which is engaged, in the direction of the rod 17 or in the direction of transport T. The transport speed T of the rod 17 and the axial speed component of the cutting wheel 32 or blade 33 at the point of intersection S are almost identical. The angle of inclination β is variable. However, in order to fulfill the condition of "equality of the rod speed and the axial speed component" with the altered angle β, the revolution of the cutting wheel 32 is to be altered, which in turn leads to shortened or lengthened articles, namely the sticks 34.

In order to show a particularly preferred embodiment, the cutting device 18 additionally includes a blade carrier 35 and a blade table 36. The blade carrier 35 serves to mount the cutting wheel 32 and is arranged on the blade table 36. The drive 31 for the cutting wheel 32 is associated with the blade carrier 35. The blade table 36 itself is movable, namely in particular pivotable. For this, the blade table 36 is pivotable about a pivot axis 37. The pivot axis 37 runs perpendicularly to the rod 17 in the shown embodiment. Pivoting about this pivot axis 37 leads to alteration of the angle β. For automated pivoting of the blade table 36 and hence of the blade carrier 35 or cutting wheel 32, the adjusting drive 27 is associated with the blade table 36. The blade table 36 itself is mounted on a base 38 which is in turn fixed to the frame. On the base 38 is arranged a carrier 39 for a supporting element 40 of the cutting wheel 32. The stationary and rigid supporting element 40 is connected by a joint connection 41 to the cutting wheel 32 and serves to guide the blades 33 which are arranged on the circumference of the cutting wheel 32 and have radially inwardly directed guide elements (not shown). This ensures that the blades 33 are always perpendicular to the rod 17, independent of the angle β at the point of intersection S.

Figure 4:
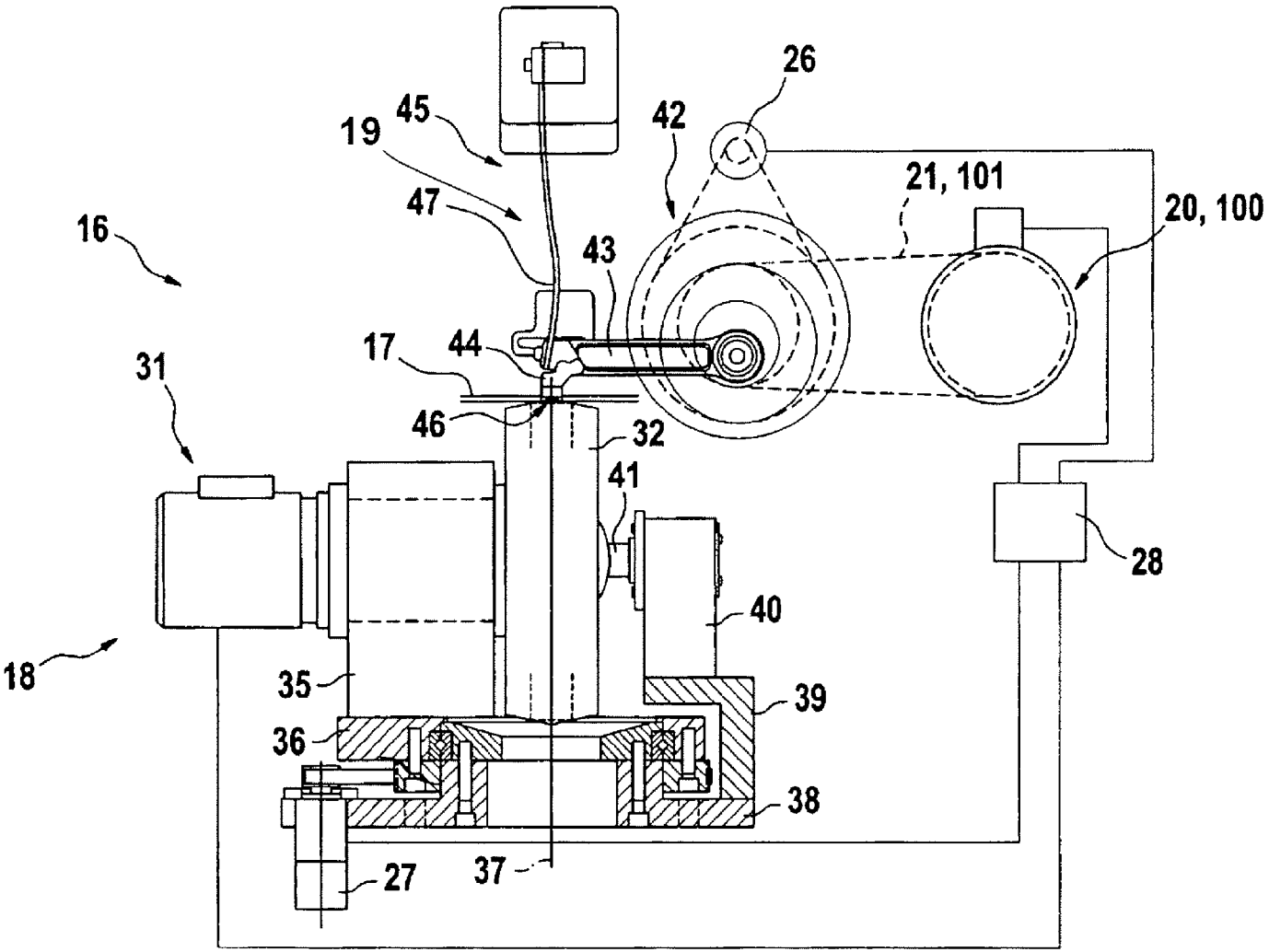

The counter-support 19 in a first variant in FIGS. 2 to 4 is designed as a tube drive and includes an eccentric unit 42. Associated with the eccentric unit 42 is a connecting rod 43, a holding element 44 and a guide element 45 for the connecting rod 43. The eccentric unit 42 or the components associated with the eccentric unit 42 also ensure an axial speed component of the holding element 44, which has a cutting gap 46, in the direction of the rod 17 or its direction of transport T. The holding element 44, that is, the so-called tube, is arranged at a free end of the connecting rod 24. With the other end the connecting rod 24 is attached to the eccentric unit 42. The guide element 45 in the shown embodiment is designed as a leaf spring 47. The leaf spring 47 is attached by one end to the connecting rod 43 and by the other end to the frame. Instead of the leaf spring 47, however, other common guide elements 45 can be used. Due to the design of the counter-support 19 as described, the axial speed component of the holding element 44 is reached, which at the point of intersection S must correspond to the axial speed component of the blade 33.

The rotation speed ratios of cutting device 18 and counter-support 19 correspond to each other. This means, for the embodiment of FIG. 4, that the two drives 20, 31 are coordinated with each other so as to be in the same rotation speed ratio to each other. At the point of intersection S of blade 33 and rod 17, the blade 33 and the holding element 44 with the cutting gap 46 are diametrically opposed to each other, in such a way that the rod 17 is guided within the holding element 44, namely in the tube, and the blade 33 for complete passage through the rod 17 enters the cutting gap 46 of the holding element 44. Both the blade 33 and the holding element 44 run with the rod 17 in the axial direction in the transport direction T, so that during cutting there is no relative movement between rod 17, blade 33 and holding element 44.

To adjust the eccentricity, that is, to vary the stroke of the eccentric unit 42, associated with the counter-support 19 or, to be more precise, the eccentric unit 42 itself is a device 48 for superimposing a rotary movement in addition to the rotational movement of the eccentric unit 42, the rotational movement being produced by a drive shaft 49 functionally connected to the drive 20. The device 48 is preferably constructed as an addition gear mechanism 50. Other mechanical solutions for superimposing an additional movement on the eccentric unit 42 can be used as well. The addition gear mechanism 50 essentially includes two planetary gear mechanisms 51, 52 which are connected in parallel with each other. Further, a displacing shaft 53 forms part of the device 48. The two planetary gear mechanisms 51, 52 are arranged as a link member between the adjusting drive 26 and the displacing shaft 53. The two planetary gear mechanisms 51, 52 have a hollow wheel 54 or 55, a set of planet wheels 56 or 57 and a sun wheel 58 or 59. Each set of planet wheels 56, 57 includes one or more planet wheels, whereby two planet wheels each are provided in the shown embodiment. All or also single drives 20, 31 or adjusting drives 26, 27 are preferably designed as electric motors.

The adjusting drive 26 is functionally connected to the hollow wheel 54 for example by a toothed belt 60 or the like. The hollow wheel 54 is firstly centered directly on the displacing shaft 53 and secondly centered indirectly on the displacing shaft 53 via a set of planet wheels 56 and the sun wheel 58. The hollow wheel 55 is arranged stationarily on the frame 61 and positioned centrally relative to the drive shaft 49 of the eccentric unit 42. The sun wheel 59 is rigidly connected to the drive shaft 49. The planet wheels of both sets 56, 57 are associated with each other in pairs, whereby one planet wheel each of the set 56 is arranged with one planet wheel each of the set 57 on a common axis 62 or 63. The displacing shaft 53 is arranged within the drive shaft 49 constructed as a hollow shaft 64, displacing shaft 53 and hollow shaft 64 being mounted opposite each other. The displacing shaft 53 protrudes from the hollow shaft 64 on the side facing towards the eccentric unit 42. At the end of the displacing shaft 53 protruding from the hollow shaft 64 is arranged a gear 65. The gear 65 is preferably constructed with the displacing shaft 53 in one piece and functionally connected to the eccentric unit 42. Usually, the displacing shaft 53 and hollow shaft 64 rotate synchronously at the same speed. By operation of the adjusting drive 26 in addition to operation of the drive 20, a speed difference can be produced between displacing shaft 53 and hollow shaft 64, so that a superimposed movement can be applied to the eccentric unit 42, leading to adjustment of eccentricity. The hollow shaft 64 is for its part functionally connected to the drive 20, for example, via a toothed belt 66 or the like.

Figure 6:
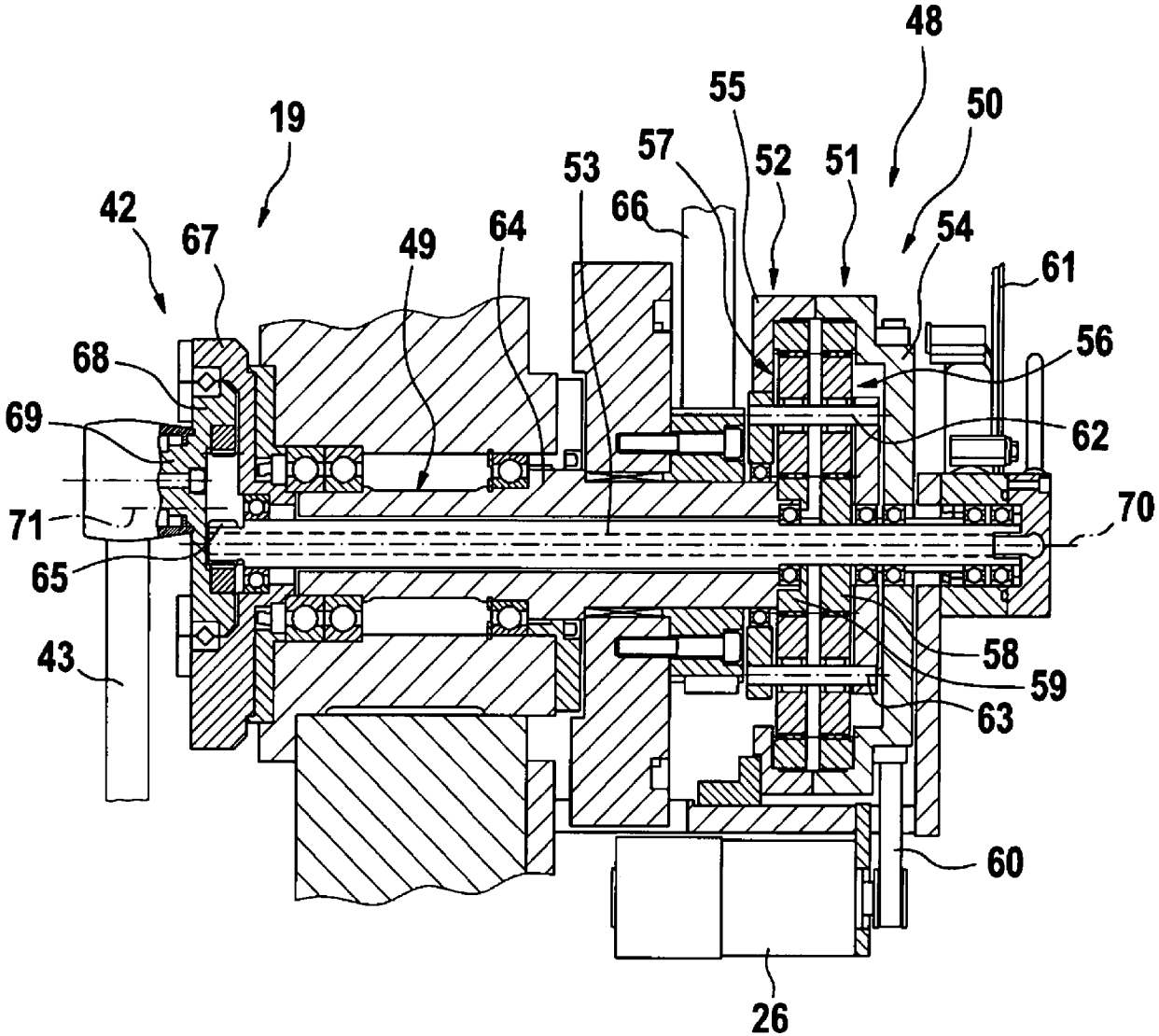

The eccentric unit 42 shown in FIG. 6 is a first embodiment of the first construction variant. The eccentric unit 42 according to FIG. 6 has, to form a double eccentric, a first disc 67, a second disc 68 and a journal 69. The first disc 67 is associated with the drive shaft 49 of the eccentric unit 42 and mounted non-rotatably on the eccentric unit 42 symmetrically to the axis of rotation 70 of the displacing shaft 53 or hollow shaft 64. The first disc 67 is thus directly rotatable by the drive shaft 49. The second disc 68 is arranged eccentrically to the first disc 67 and mounted opposite the latter. The second disc 68 is functionally connected to the gear 65 of the displacing shaft 53. On the second disc 68 is arranged the journal 69, this being eccentrically to the centre axis 71 of the disc 68. The journal 69 is preferably an integral part of the disc 68, namely connected in one piece with the latter, and serves to receive the connecting rod 43.

Figure 7:
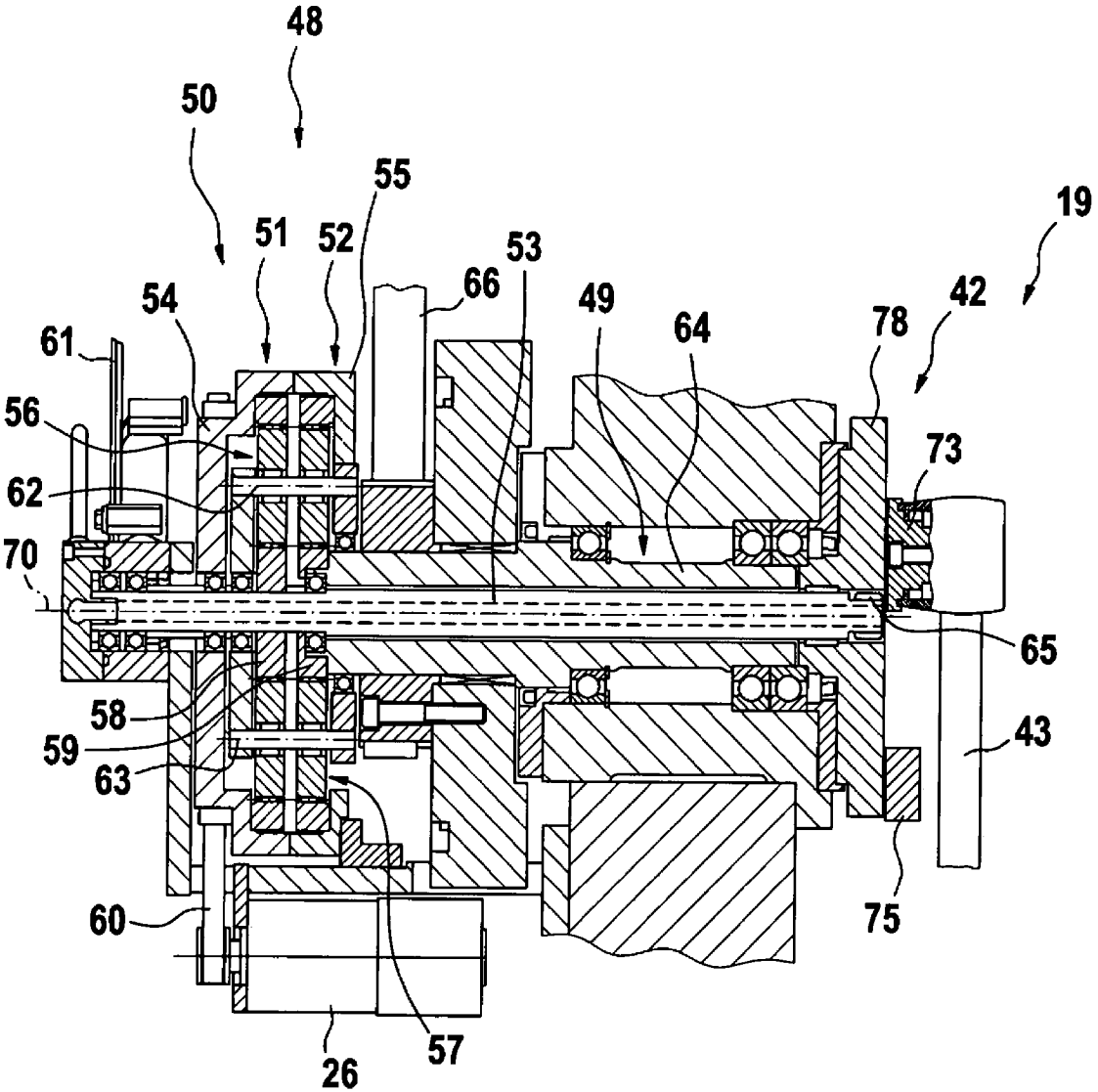
Figure 8A:
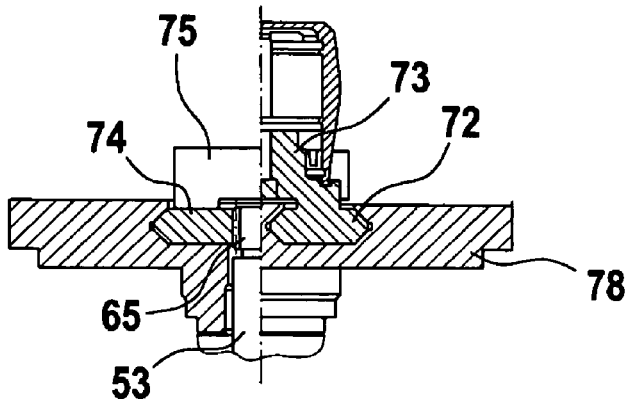
Figure 8B:
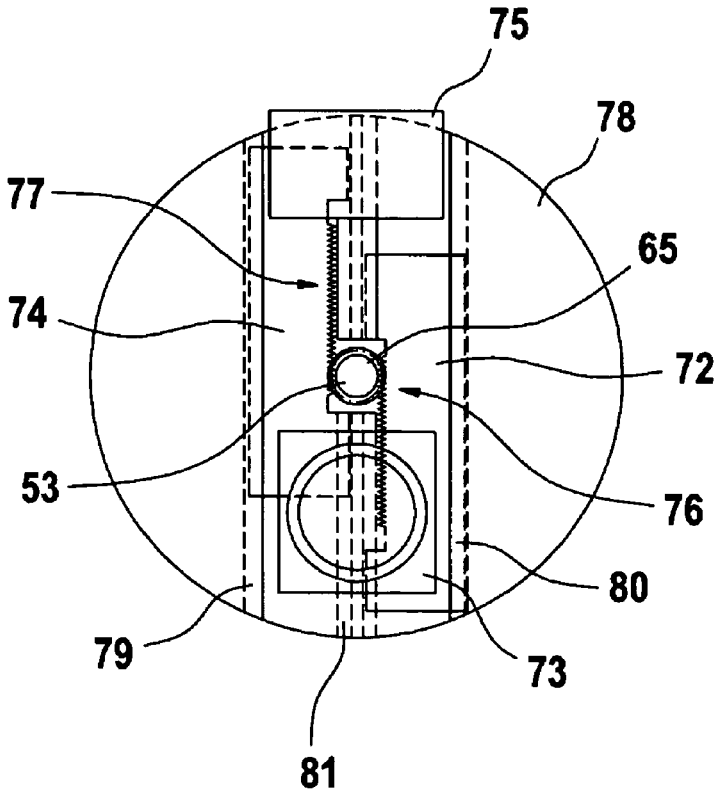
Figure 8C:
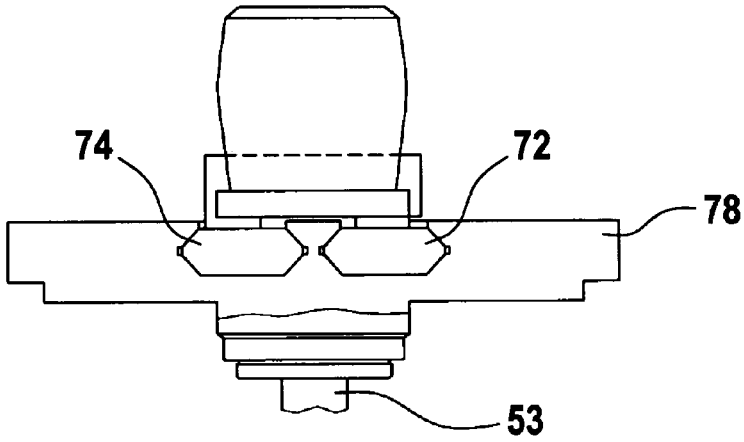
Figure 8D:
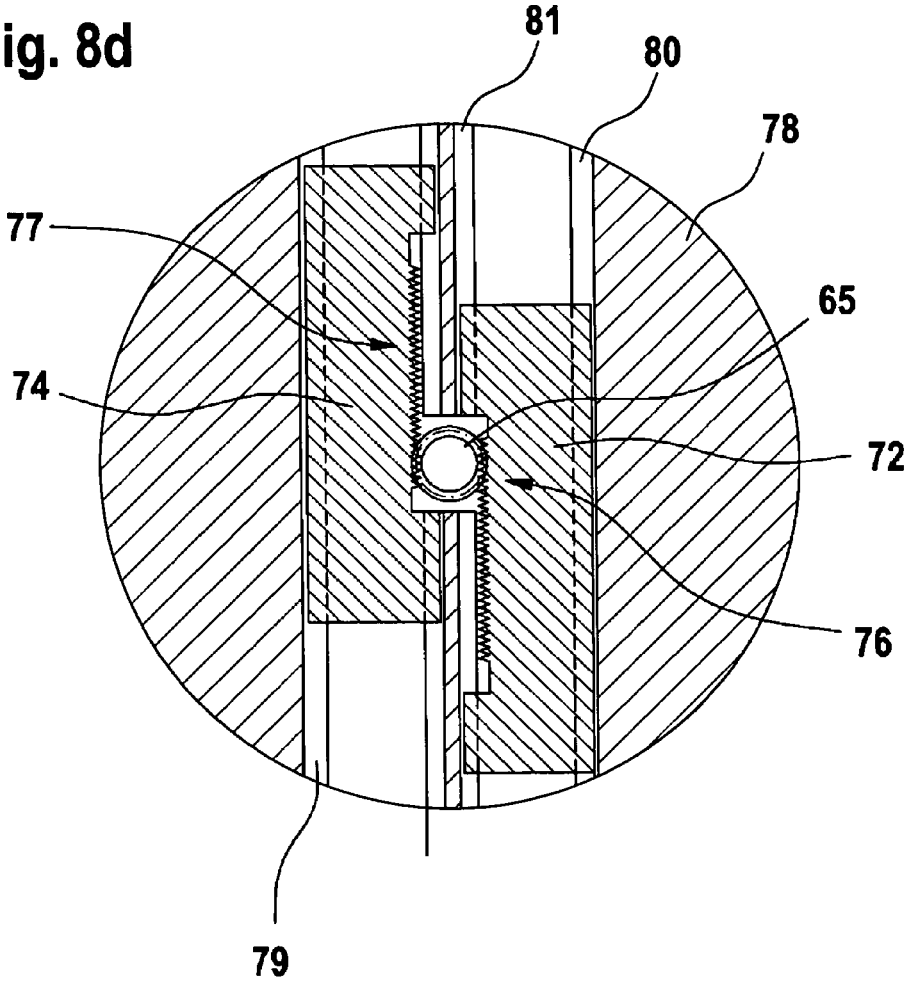

An alternative embodiment of the first variant can be seen in FIG. 7. The eccentric unit 42 shown therein is formed from a rack rail system. The addition gear mechanism 50 is provided and designed in the same way as described above, so that a repeated description is dispensed with. The eccentric unit 42 can be formed from a rack rail 72 and a journal 73. The journal 73 is arranged on the rack rail 72. In other words, the rack rail 72 carries the journal 73, which is arranged eccentrically to the displacing shaft 53 for the rack rail 72. Preferably and according to FIG. 7, however, the eccentric unit 42 has two rack rails, namely the rack rail 72 which carries the journal 73, and a rack rail 74 which carries a balance weight 75. The rack rails 72, 74 are provided with a tooth system 76 or 77, this being to form a linear guide. The two rack rails or plane bars 72, 74 are engaged and hence operatively connected to the gear 65 of the displacing shaft 53 by means of the tooth system 76, 77. By rotation of the gear 65, the rack rails 72, 74 are linearly movable in opposite directions. The rack rails 72, 74 are arranged on a plate 78 which is arranged rigidly, and so non-rotatably, on the hollow shaft 64. The guide element 45 in this embodiment is formed from several guides, preferably two lateral guides 79, 80 and a centre guide 81. The details of the embodiment of FIG. 7, in particular the design and layout of the rack rails 72, 74, can be seen from FIGS. 8*a* to *d*.

Figure 9A:
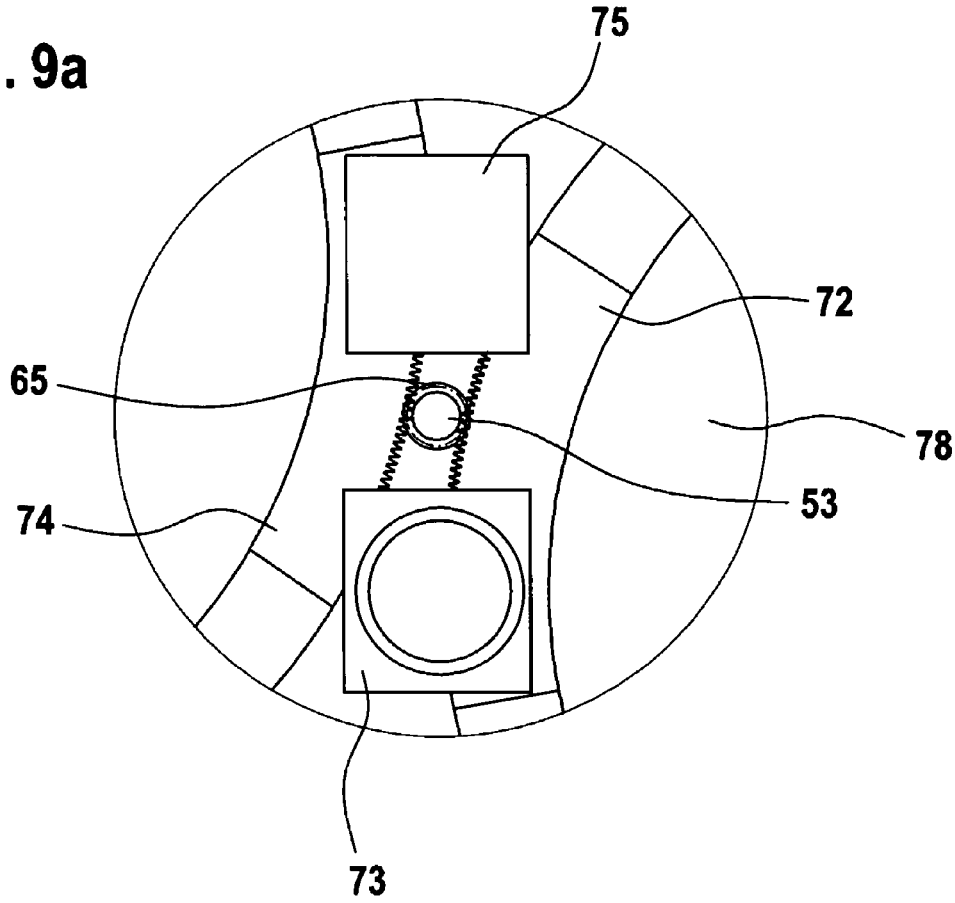

In FIGS. 9*a* and *b* is shown a further embodiment of the first variant. The eccentric unit 42 in FIG. 9 essentially corresponds to the eccentric unit 42 which has been described with the aid of FIGS. 7 and 8, so that a repeated description is dispensed with. Unlike the above-described design of the rack rail system, however, the rack rails 72, 74 have a curved construction. Upon actuation of the displacing shaft 53 which is engaged with the tooth systems 76, 77, the rack rails 72, 74 as it were roll over each other. The curvature may be circular, arcuate or otherwise shaped.

In a further embodiment, not shown, in addition an unbalanced shaft may be provided. The unbalanced shaft serves to equalise the radial stroke of the eccentric unit 42 and can be driven by the drive 20, which also serves to drive the hollow shaft 64. On the unbalanced shaft is arranged a displacing weight which is radially positionable in linear guides.

The counter-support 19 designed as a so-called tube drive is described only as an example. Alternatively, otherwise known elements can be used as a counter-support 19 with corresponding holding element or elements.

Figure 10:
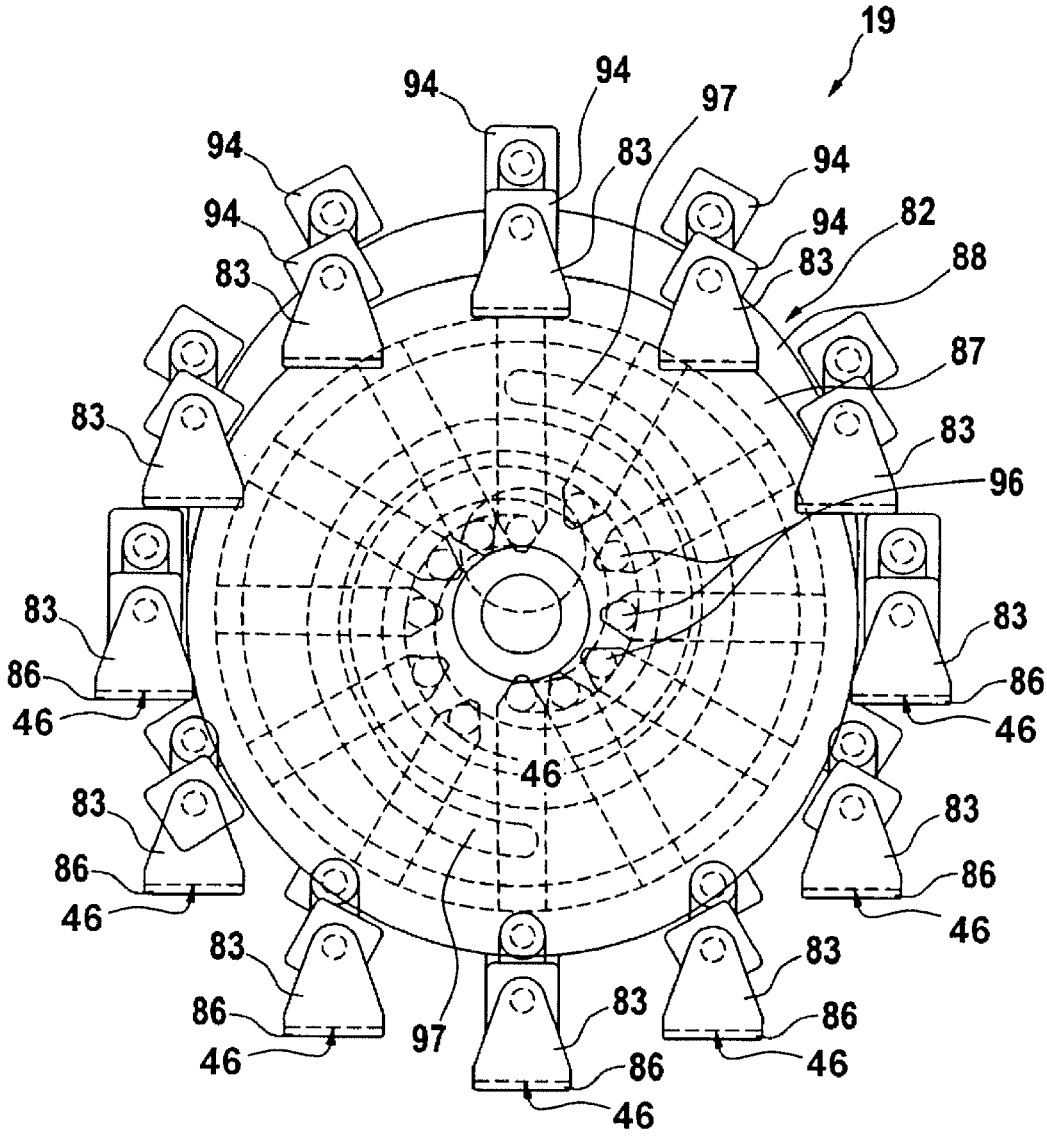
Figure 11:
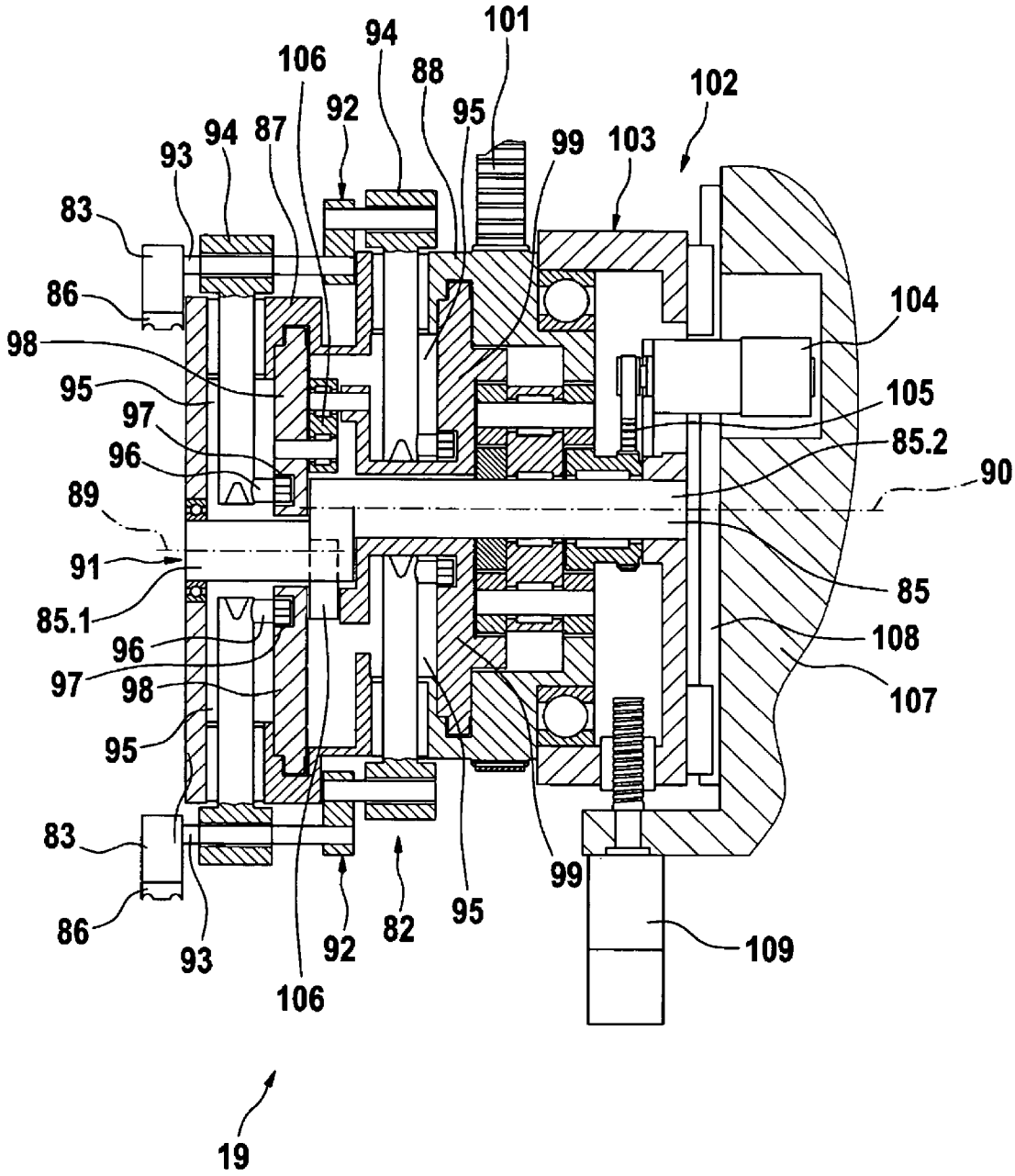

Instead of the tube drive, according to a second variant e.g. a tube wheel as in FIGS. 10 and 11 can be used as the counter-support 19. The tube wheel essentially includes a rotatable element 82 which serves as a conveying means and has at least one, but preferably several holding elements 83. The holding elements 83 serve to hold and guide the rod 17 or rods 17 in particular at the moment of cutting the rod 17 or rods 17. Each holding element 83 has a cutting gap 46 which is designed for plunging the blade 33 into. The element 82 is rotatable about an axis 85. Several, preferably twelve holding elements 83 are evenly distributed over the circumference of the element/conveying means 82. Each holding element 83 is arranged pivotably on the conveying means 82, so that format holders 86 which are associated with each holding element 83 and in the shown embodiment by way of example are designed to hold two rods 17 transported in parallel, preferably in each position, but in particular at the moment of counter-holding during cutting of the rod 17 or rods 17 run parallel to the rod 17 or rods 17. This is usually the horizontal position. To alter the radius of the conveying means 82 or, to be more precise, the running circle L formed by the rotating holding elements 83, the holding elements 83 are radially displaceable. Displacement can be effected manually or automatically.

The conveying means 82 has two discs 87 and 88 which are mounted on the common shaft 85. The preferably single-piece shaft 85 is bent or offset parallel, i.e. it has two sections 85.1 and 85.2 which are parallel to and offset from each other. The sections 85.1 and 85.2 or the centre axes 89 and 90 of the sections 85.1 and 85.2 run parallel to each other. The outer disc 87 which is arranged at the free end 91 of the shaft 85 is associated with the section 85.1 and rotates about the centre axis 89. The inner disc 88 is associated with the section 85.2 and rotates about the centre axis 90. Accordingly, the discs 87, 88 are arranged parallel to and axially offset from each other. The two discs 87, 88 are coupled together by joint elements 92 and hence functionally connected, in such a way that they rotate about the centre axes 89, 90 at the same speed. The holding elements 83 are associated with the front disc 87. To be more precise, the holding elements 83 are arranged non-rotatably at free ends 93 of the joint elements 92 which protrude beyond the disc 87.

The discs 87, 88 in the shown embodiment have the same diameter. The diameters can be different, however. Each disc 87, 88 has adjusting elements 94. The adjusting elements 94 are arranged in the region of the circumference of the respective disc 87 or 88. The number of adjusting elements 94 per disc 87, 88 corresponds to the number of holding elements 83. The adjusting elements 94 are segmented, i.e. each adjusting element 94 is designed separately from the adjacent adjusting element 94. Each holding element 83 is associated with a pair of adjusting elements. The pair of adjusting elements is formed from an adjusting element 94 of the disc 87 and a corresponding adjusting element 94 of the disc 88. The adjusting elements 94 of a pair of adjusting elements are arranged one behind the other in a front view. The connection between the discs 87, 88 or between the adjusting elements 94 of each pair of adjusting elements is made by the joint elements 92 which, like the shaft 85, are offset and parallel. The joint elements 92 are mounted in the adjusting elements 94, so that the holding elements 83 arranged on the joint elements 92 in spite of rotation of the discs 87, 88 are always in the same position in relation to the orientation to the rods 17. The adjusting elements 94 are arranged in recesses 95 of the discs 87, 88.

The adjusting elements 94 can have different embodiments. An embodiment is shown in which the adjusting elements 94 each have a pin 96 or the like, the pins 96 being guided in a control or adjusting cam 97. The adjusting cam 97 or several adjusting cams 97, starting from the shaft 85, run spirally radially outwards, so that a change of position of the adjusting cams 97, in particular rotation of the discs 98 or 99 comprising the adjusting cams 97, automatically results in radial displacement of the pins 96 guided in the adjusting cams 97 and hence of the adjusting elements 94 per se. In other embodiments, associated with the adjusting elements 94 are spindles by means of which the adjusting elements 94 are radially movable. For this, the spindles are radially oriented and run transversely to the shaft 85. Other ordinary displacement mechanisms can be used as well.

The discs 87, 88 are rotatable by means of a drive 100. The drive 100 is functionally connected to the disc 88 by a toothed belt 101 or other transmission elements. By the joint elements 92, rotation of the disc 88 can be transmitted to the disc 87. The two discs 87, 88 rotate basically at the same speed. To vary the diameter of the conveying means 82 or the running circle L described by the holding elements 83, an additional movement can be superimposed on the rotational movement of the discs 87, 88. For this purpose, a device 102 which corresponds to the device 48 is arranged upstream from the discs 87, 88 is. The device 102 is also designed as an addition gear mechanism 103. The addition gear mechanism 103, the constituents of which have already been described above in connection with the other embodiments, is driven by means of an adjusting drive 104 which is functionally connected to the gear mechanism 103 by means of a toothed belt 105 or an equivalent transmission element. Other mechanical solutions for superimposing an additional movement can be used too. The adjusting elements 94 of a pair of adjusting elements are functionally connected to each other by a coupling 106, in particular a Schmidt coupling. Other types of coupling, e.g. an Oldham coupling or cardan shafts or other ordinary coupling elements can be used too.

The tube wheel can e.g. be integrated in the arrangement of FIG. 4, so that then the drive 100 and the adjusting drive 104 are connected to the control system 28. The whole unit consisting of conveying means 82, gear mechanism 103 and coupling(s) 106 is arranged on a frame 107 and guided on or in linear guides 108. By an adjusting drive 109, the whole unit is adjustable in height. The height adjustment serves to equalise the change of diameter of the conveying means 82 or to equalise the radial displacement of the holding elements 83. The adjusting drive 109 can also be connected to the control system 28.

Alternatively to the above-described connections of the cutting device 18 to the counter-support 19, which are formed from a combined mechanical and electrical coupling, the connection can also be purely electrical or purely mechanical.

Below, the principle of the method for varying the cut length of the articles is described in more detail by way of example first with the aid of a single rod 17 of tobacco, in particular with the aid of FIGS. 4 and 6.

The rod 17 is made in the continuous rod-making machine 10 in particular with the means 14. From the endless rod 17 which is conveyed continuously, the apparatus 16 now cuts off single articles, i.e. the sticks 34. The inclined cutting wheel 32 with the blades 33 rotates. Upon impingement of one of the blades 33 on the rod 17, that is, at the point of intersection S, the blade 33 is perpendicular to the rod 17. The rod 17 is held or guided in the holding element 44, the tube. This prevents the rod 17 from yielding laterally to the blade 33 during cutting. The holding element 44 thus acts as an abutment. To achieve full cutting right through the rod 17, the blade 33 emerges again on the opposite side of the rod 17, whereby the blade 33 plunges into the cutting gap 46 at this moment. During the whole cutting movement or performance, rod 17, blade 33 and holding element 44 move at the same speed in the direction of transport T, as both the blade 33 and the holding element 44 have an axial speed component at the point of intersection S. For the blade 33, this speed component is determined by the angle of inclination β of the cutting wheel 32 to the rod 17. For the holding element 44, the speed component is defined by the stroke or the eccentricity of the connecting rod 43. The determining parameter for the cut length is, however, preferably the angle of inclination β. Depending on the size of the angle of inclination β, the rotation speed of the cutting wheel 32 must alter too in order to fulfill the necessary condition of optimum cutting, "axial speed component of the blade corresponds to conveying speed of the rod", as the rod 17 is always conveyed at a constant speed. Due to the speed of rotation or circumferential speed of the cutting wheel 32 there is a certain cut length of the sticks 34. If e.g. the angle of inclination β is decreased, the speed of rotation must be reduced too. With the reduced speed of rotation, the time between two cuts lengthens, so that it leads to longer sticks 34 as a result. Associated with every length of stick 34 is therefore a data record which contains the essential parameters of rod speed, angle of inclination, speed of rotation of cutting wheel for the respective apparatus 16.

The variation in length of sticks 34 is now commenced according to the invention in such a way that an operator enters an altered stick length, for example, via a control console, and hence conveys it to the control system 28. The control system 28 seeks the corresponding angle of inclination β for the predetermined stick length, triggers a displacement of the blade table 36 by means of the adjusting drive 27, and adapts the rotation speed of the cutting wheel 32 via the drive 31 to the altered angle of inclination β. Almost synchronously, the control system 28 transmits the altered data to the adjusting drive 26 and the drive 20, and ensures adaptation of the holding elements 44 to the new positioning/setting of the blade 33. In other words, the position of the holding elements 44 is reset, so that in spite of the altered cut length at the point of intersection S it is again diametrically opposite the blade 33. All steps take place automatically and are therefore independent of the operator and can take place during operation of the apparatus 16 or continuous rod-making machine 10. To be more precise, the following happens: after or due to the displacement of the angle of inclination β and the resulting change of rotation speed of the cutting wheel 32, the adjusting drive 26 is activated and drives the addition gear mechanism 50. Due to the addition gear mechanism 50, a speed difference is produced between the displacing shaft 53 and the drive shaft 49 or hollow shaft 64, so that the disc 67 is driven at a speed which differs from the driving speed of the disc 68. As a result, the stroke or eccentricity of the journal 69 and hence of the connecting rod 43 is adjusted. This leads to displacement of the position/setting of the holding elements 44 as a function of the initially altered angle of inclination β, and adaptation of the rotation speeds or rotation speed ratio of the drives 20 and 31.

Figure 9B:
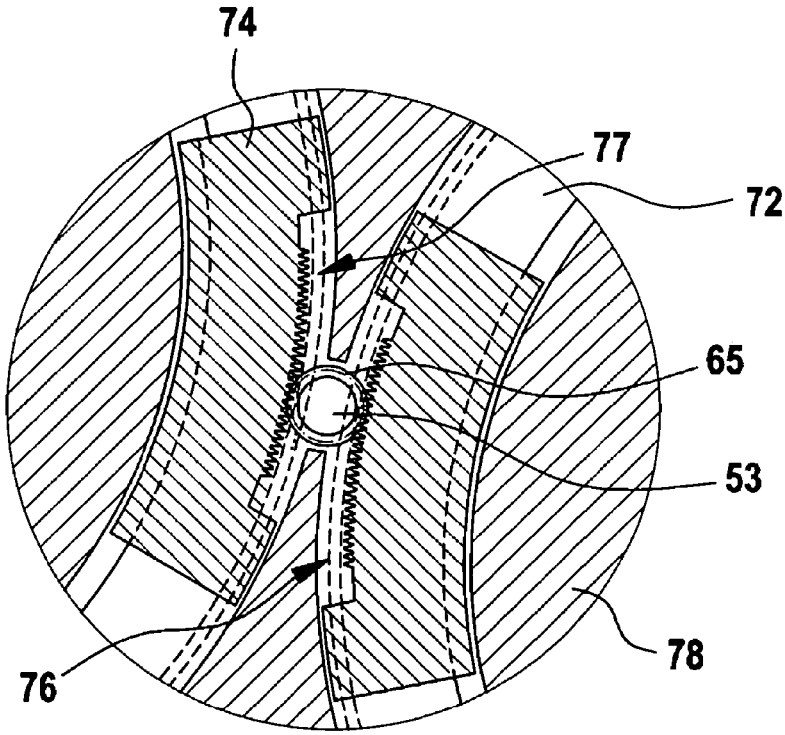

With reference to the embodiment as in FIGS. 7 to 9, the method essentially proceeds the same. The method differs in that the plate 78 is driven at the driving speed of the hollow shaft 64, while the speed difference between displacing shaft 53 and hollow shaft 64 leads to the displacing shaft 53 causing a shift of the rack rails 72, 74, altering the eccentricity of the journal 73 and hence of the connecting rod 43. This, in turn, leads to displacement of the position/setting of the holding elements 44 as a function of the initially altered angle of inclination β. In case of use of linear rack rails 72, 74 or double eccentric, an equalising adjustment is necessary. With the adjustment of eccentricity or stroke, the drive shaft of the drive 20 also rotates. This phase shift must then be equalised by means of the adjusting drive 30. This equalising adjustment is eliminated if curved rack rails 72, 74 are used, since no phase shift occurs due to the curvature of the rack rails 72, 74.

Naturally, the procedures described also apply to several rods 17 of tobacco, filter material or other materials to be cut simultaneously. Adjustment of the angle of inclination β can also be effected manually on the cutting wheel 20. The further adjustments/adaptations then automatically result from the coupling of cutting device 18 and counter-support 19.

The cutting of several rods 17 simultaneously, this being with variable length, is described in more detail with the aid of FIGS. 4 and 11. Variation in length of the sticks 34 is now commenced according to the invention in such a way that an operator enters an altered stick length, for example via a control console, and hence conveys it to the control system 28. The control system 28 seeks the corresponding angle of inclination β for the predetermined stick length, triggers a displacement of the blade table 36 by means of the adjusting drive 27, and adapts the rotation speed of the cutting wheel 32 via the drive 31 to the altered angle of inclination β. Almost synchronously, the control system 28 transmits the altered data to the adjusting drive 104 and the drive 100, and ensures adaptation of the holding elements 83 to the new positioning/setting of the blade 33. In other words, the position of the holding elements 83 is reset, so that in spite of the altered cut length at the point of intersection S it is again diametrically opposite the blade 33. All steps take place automatically and are therefore independent of the operator and can take place during operation of the apparatus 16 or continuous rod-making machine 10. To be more precise, the following happens: after or due to the displacement of the angle of inclination β and the resulting change of rotation speed of the cutting wheel 32, the adjusting drive 104 is activated and drives the addition gear mechanism 103. Due to the addition gear mechanism 103, a rotational movement superimposed on the rotational movement is applied to the discs 98, 99, leading to rotation of the adjusting cams 97. By the adjusting cams 97, the pins 96 are moved radially outwards or inwards, depending on the direction of rotation of the discs 98, 99, which due to the displacement of the adjusting elements 94 leads to a change of diameter of the running circle L. If the diameter of the running circle L increases with a constant number of holding elements 83, the cut length also increases because the intervals at which a holding element 83 passes through the point of intersection S increase. By reduction of the diameter, shortening of the cut length is achieved.

As the rod 17 or rods 17 are always conveyed in the same plane, in case of a change of diameter of the running circle an adaptation of height of the conveying means 82 is necessary, so that the holding elements 83 correspondingly always lie in the plane of the rod at the point of intersection S. For adaptation of height, the adjusting drive 109 which moves the whole unit including the conveying means 82 up or down is activated.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. Apparatus for cutting at least one continuously conveyed rod into rod-shaped articles of variable length, in particular cigarettes, filters or the like, comprising:

a cutting device, a counter-support including a holding element adapted to support the continuously conveyed rod, the holding element located diametrically opposite to the cutting device with respect to the rod, and a first displacing device for the cutting device and a second displacing device for the counter-support, the first and second displacing devices being operable to vary the cut length of the articles, wherein the first and second displacing devices are coupled together for coordinated movement of the cutting device and the holding element with respect to one another, wherein the counter-support comprises a tube drive including an eccentric unit, and the eccentric unit includes a first rack rail and a journal, the first rack rail carrying the journal arranged eccentrically to a displacing shaft of the first rack rail.

2. Apparatus according to claim 1, further comprising a second rack rail that carries a balance weight.

3. Apparatus according to claim 1, wherein at least one of the first and second rack rails has a curved construction.

* * * * *